US008911300B1

(12) United States Patent
Alvarado

(10) Patent No.: US 8,911,300 B1
(45) Date of Patent: Dec. 16, 2014

(54) GOLF TRAINING AID ASSEMBLY

(71) Applicant: Matilde G. Alvarado, Pollack Pines, CA (US)

(72) Inventor: Matilde G. Alvarado, Pollack Pines, CA (US)

( * ) Notice: Subject to any disclaimer, the term of this patent is extended or adjusted under 35 U.S.C. 154(b) by 0 days.

(21) Appl. No.: 14/146,841

(22) Filed: Jan. 3, 2014

(51) Int. Cl.
*A63B 69/36* (2006.01)

(52) U.S. Cl.
CPC ..... *A63B 69/3661* (2013.01); *A63B 2243/0029* (2013.01)
USPC ..... 473/278; 473/262

(58) Field of Classification Search
USPC ..... 473/218, 257, 262, 278, 279, 409
See application file for complete search history.

(56) References Cited

U.S. PATENT DOCUMENTS

| | | | | | |
|---|---|---|---|---|---|
| 1,363,446 | A | * | 12/1920 | Vogel | 473/139 |
| 1,753,654 | A | * | 4/1930 | Hanson | 473/139 |
| 3,345,073 | A | * | 10/1967 | Hoffman | 473/139 |
| 3,717,349 | A | | 2/1973 | Bohnen | |
| 3,936,055 | A | | 2/1976 | Scott | |
| 4,130,283 | A | | 12/1978 | Lindquist | |
| 4,311,312 | A | | 1/1982 | O'Brien | |
| 4,875,685 | A | | 10/1989 | Ballinger et al. | |
| 5,549,299 | A | * | 8/1996 | Brown | 473/133 |
| 5,692,967 | A | | 12/1997 | Guyer | |
| 6,156,396 | A | | 12/2000 | Florian | |
| 6,623,373 | B2 | | 9/2003 | Carlton et al. | |
| 6,746,340 | B1 | | 6/2004 | Dover | |
| 7,549,932 | B1 | * | 6/2009 | Miyamoto | 473/278 |
| 8,157,667 | B2 | | 4/2012 | Tome et al. | |
| 2012/0178546 | A1 | * | 7/2012 | Park | 473/278 |

* cited by examiner

*Primary Examiner* — Nini Legesse

(57) ABSTRACT

A golf training aid assembly simulates taking a divot while swinging a golf club. The assembly includes a platform having a top surface. A resiliently flexible member is coupled to the platform. A panel has a first end pivotally coupled to the platform wherein the panel is pivotable relative to the platform. The panel is supported on the resiliently flexible member in spaced relationship to the first end of the panel such that a top surface of the panel is coplanar with the top surface of the platform when the panel rests upon the resiliently flexible member. The panel is downwardly pivotable relative to the top surface of the platform such that the top surface of the panel is configured for being urged downwardly when contacted by a golf club head. The resiliently flexible member is deformable and provides resistance to downward pivoting of the panel.

20 Claims, 3 Drawing Sheets

GOLF TRAINING AID ASSEMBLY

BACKGROUND OF THE DISCLOSURE

Field of the Disclosure

The disclosure relates to golf swing training aid devices and more particularly pertains to a new golf swing training aid device for striking a golf ball from a resiliently supported pivoting surface wherein pivoting of the pivoting surface while striking the golf ball simulates taking a divot while swinging a golf club.

SUMMARY OF THE DISCLOSURE

An embodiment of the disclosure meets the needs presented above by generally comprising a platform having a top surface. A resiliently flexible member is coupled to the platform. A panel has a first end pivotally coupled to the platform wherein the panel is pivotable relative to the platform. The panel is supported on the resiliently flexible member in spaced relationship to the first end of the panel such that a top surface of the panel is coplanar with the top surface of the platform when the panel rests upon the resiliently flexible member. The panel is downwardly pivotable relative to the top surface of the platform such that the top surface of the panel is configured for being urged downwardly when contacted by a golf club head. The resiliently flexible member is deformable and provides resistance to downward pivoting of the panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
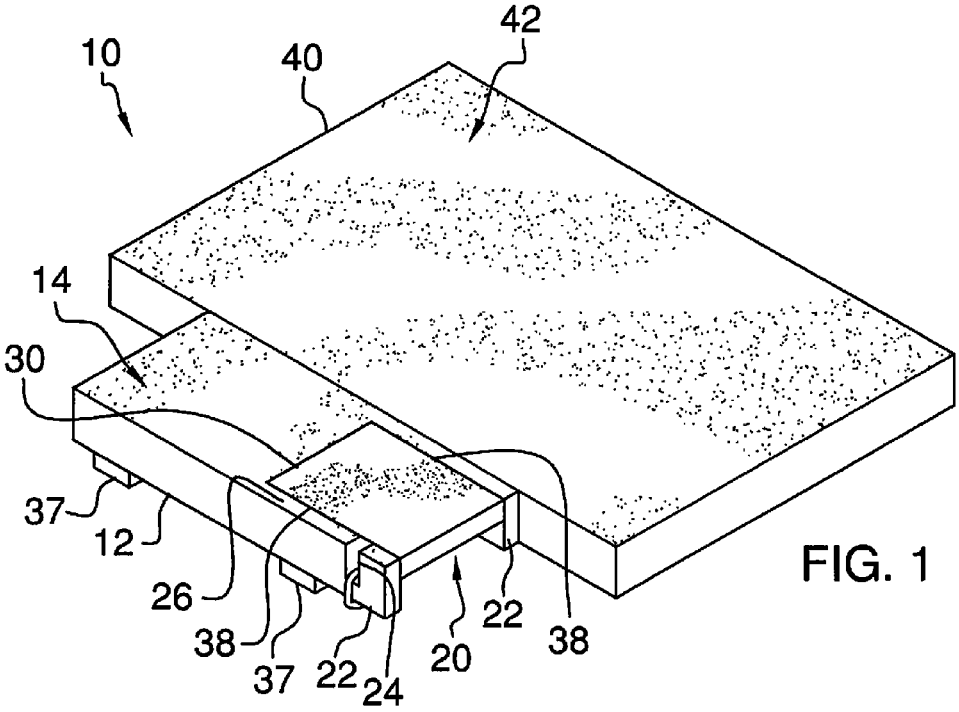
FIG. 1 is a top perspective view of a golf training aid assembly according to an embodiment of the disclosure.
Figure 2:
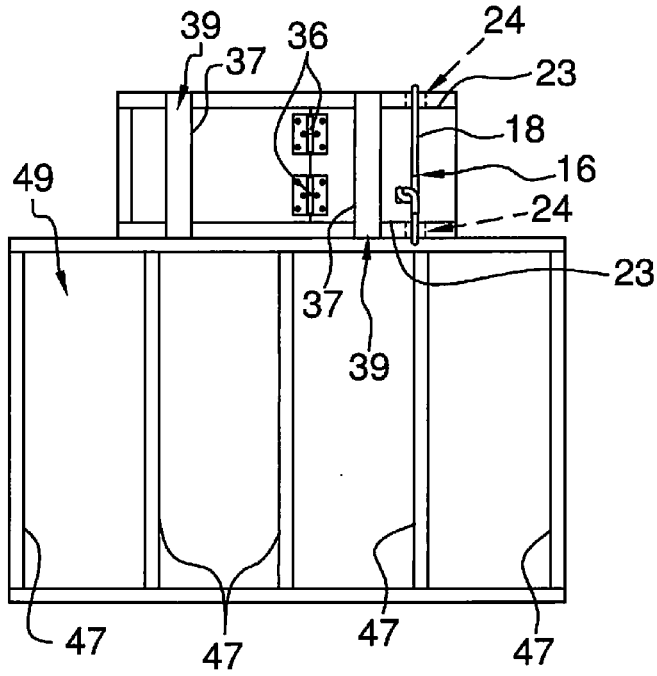
FIG. 2 is a bottom view of an embodiment of the disclosure.
Figure 3:
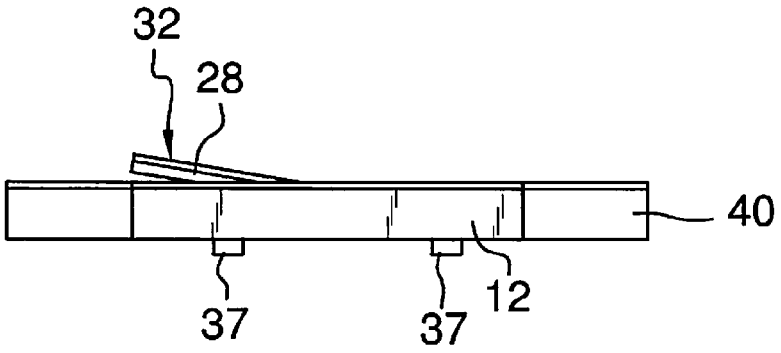
FIG. 3 is a front view of an embodiment of the disclosure.
Figure 4:
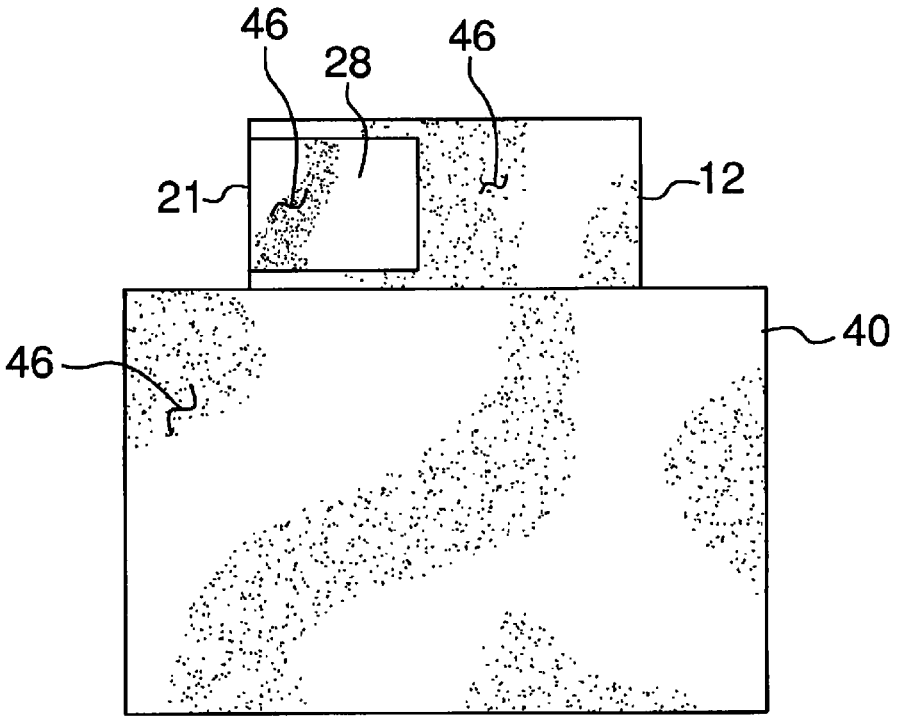
FIG. 4 is a top view of an embodiment of the disclosure.
Figure 5:
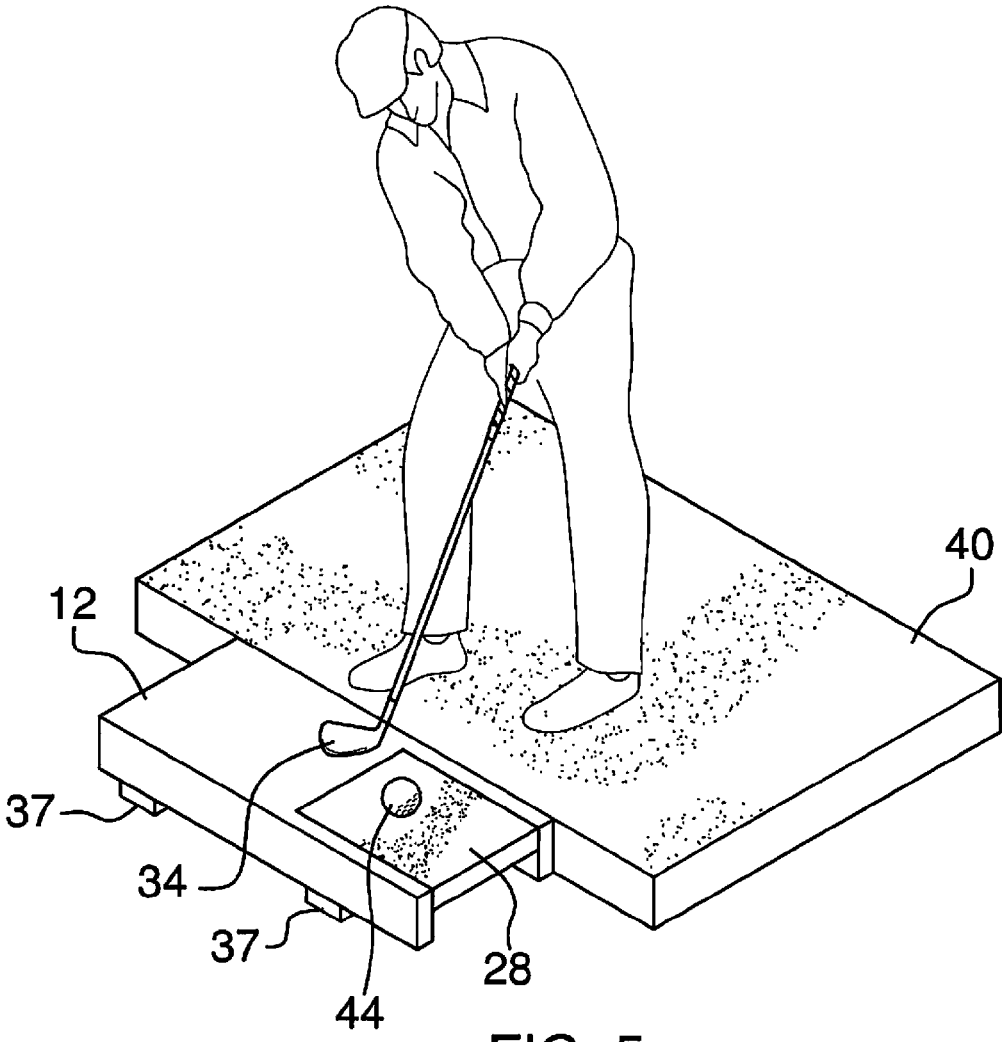
FIG. 5 is an-use top perspective view of an embodiment of the disclosure.

With reference now to the drawings, and in particular to FIGS. 1 through 5 thereof, a new training aid device embodying the principles and concepts of an embodiment of the disclosure and generally designated by the reference numeral 10 will be described.

As best illustrated in FIGS. 1 through 5, the golf training aid assembly 10 generally comprises a platform 12 having a top surface 14. A resiliently flexible member 16 is coupled to the platform 12. The resiliently flexible member 16 may be a cord 18 having a resiliently stretchable length.

A slot 20 extends inwardly into the platform 12 from a forward edge 21 of the platform 12. A pair of arms 22 is coupled to the platform 12. Each arm 22 extends along a respective side 23 of the slot 20. The resiliently flexible member 16 is coupled to and extends between the arms 22. A pair of notches 24 is provided. Each notch 24 extends into a top surface 26 of an associated one of the arms 22. The resiliently flexible member 16 extends through and between the notches 24.

A panel 28 is positioned in the slot 20. The panel 28 has a first end 30 pivotally coupled to the platform 12 wherein the panel 28 is pivotable relative to the platform 12. The panel 28 is supported on the resiliently flexible member 16 in spaced relationship to the first end 30 of the panel 28 such that a top surface 32 of the panel 28 is coplanar with the top surface 14 of the platform 12 when the panel 28 rests upon the resiliently flexible member 16. The panel 28 is downwardly pivotable relative to the top surface 14 of the platform 12 such that the top surface 32 of the panel 28 is configured for being urged downwardly when contacted by a golf club head 34 during a golf swing. The resiliently flexible member 16 is deformable wherein the resiliently flexible member 16 provides resistance to downward pivoting of the panel 28. A pair of hinges 36 couples the first end 30 of the panel 28 to the platform 12. Each of the hinges 36 is positioned adjacent a respective side edge 38 of the panel 28. A pair of feet 37 is coupled to and extends between the arms 22. The feet 37 are positioned in spaced parallel relationship relative to each other. The feet 37 abut a bottom surface 39 of each of the arms 22.

A stand 40 has a top surface 42 coplanar with the top surface 14 of the platform 12 and the top surface 32 of the panel 28. The stand 40 is laterally offset from the panel 28 wherein the stand 40 is configured for supporting a person standing on the stand 40 while the person strikes a golf ball 44 sitting upon the panel 28. A simulated grass surface 46 may be coupled to and cover the top surface 32 of the panel 28, the top surface 14 of the platform 12, and the top surface 42 of the stand 40. The stand 40 has a plurality of support studs 47 coupled to and extending downwardly from a bottom surface 49 of the stand 40.

The stand 40 may have a length between approximately 90.0 cm and 150.0 cm, a width between approximately 40.0 cm and 80.0 cm, and a height between approximately 5.0 cm and 20.0 cm. The stand 40 may be constructed from plastic, wood or the like. The panel 28 may have a length between approximately 60.0 cm and 80.0 cm and a width between approximately 20.0 cm and 60.0 cm. The panel 28 may be constructed from plastic, wood or the like. The cord 18 may have a length between approximately 30.0 cm and 90.0 cm.

In use, as stated above and shown in the Figures, a person stands upon the stand 40 and places a golf ball 44 on the panel 28. The user swings the golf club head 34 in a conventional manner and strikes the golf ball 44 with the golf club head 34. This causes the panel 28 to pivot downwardly and encounter resistance from the resiliently flexible member 16. In this manner, the assembly 10 helps simulate taking a divot while swinging a golf club and reduces shock, stress and strain felt by the wrists, hands, arms and shoulders of the person.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A golf training aid assembly comprising:

a platform having a top surface;

a resiliently flexible member coupled to said platform, said resiliently flexible member being a cord having a resiliently stretchable length; and a panel having a first end pivotally coupled to said platform wherein said panel is pivotable relative to said platform, said panel being supported on said resiliently flexible member in spaced relationship to said first end of said panel such that a top surface of said panel is coplanar with said top surface of said platform when said panel rests upon said resiliently flexible member, said panel being downwardly pivotable relative to said top surface of said platform such that said top surface of said panel is configured for being urged downwardly when contacted by a golf club head during a golf swing, said resiliently flexible member being deformable wherein said resiliently flexible member provides resistance to downward pivoting of said panel.

2. The device of claim 1, further comprising a stand having a top surface coplanar with said top surface of said platform and said top surface of said panel, said stand being laterally offset from said panel wherein said stand is configured for supporting a person standing on said stand while the person strikes a golf ball sitting upon said panel.

3. The device of claim 1, further comprising said panel being positioned in a slot extending inwardly into said platform from a forward edge of said platform.

4. The device of claim 3, further comprising a pair of arms coupled to said platform, each said arm extending along a respective side of said slot, said resiliently flexible member being coupled to and extending between said arms.

5. The device of claim 4, further comprising a pair of notches, each notch extending into a top surface of an associated one of said arms, said resiliently flexible member extending through and between said notches.

6. The device of claim 4, further comprising said simulated grass surface being coupled to and covering said top surface of said stand.

7. The device of claim 4, further comprising a pair of feet coupled to and extending between said arms, said feet being positioned in spaced parallel relationship relative to each other, said feet abutting a bottom surface of each of said arms.

8. The device of claim 1, further comprising a simulated grass surface being coupled to and covering said top surface of said panel.

9. The device of claim 8, further comprising said simulated grass surface being coupled to and covering said top surface of said platform.

10. The device of claim 1, further comprising a pair of hinges coupling said first end of said panel to said platform, each of said hinges being positioned adjacent a respective side edge of said panel.

11. A golf training aid assembly comprising:

a platform having a top surface;

a resiliently flexible member coupled to said platform, said resiliently flexible member being a cord, said cord having a resiliently stretchable length;

a slot extending inwardly into said platform from a forward edge of said platform;

a pair of arms coupled to said platform, each said arm extending along a respective side of said slot, said resiliently flexible member being coupled to and extending between said arms;

a pair of feet coupled to and extending between said arms, said feet being positioned in spaced parallel relationship relative to each other, said feet abutting a bottom surface of each of said arms;

a pair of notches, each notch extending into a top surface of an associated one of said arms, said resiliently flexible member extending through and between said notches;

a panel positioned in said slot, said panel having a first end pivotally coupled to said platform wherein said panel is pivotable relative to said platform, said panel being supported on said resiliently flexible member in spaced relationship to said first end of said panel such that a top surface of said panel is coplanar with said top surface of said platform when said panel rests upon said resiliently flexible member, said panel being downwardly pivotable relative to said top surface of said platform such that said top surface of said panel is configured for being urged downwardly when contacted by a golf club head during a golf swing, said resiliently flexible member being deformable wherein said resiliently flexible member provides resistance to downward pivoting of said panel;

a pair of hinges coupling said first end of said panel to said platform, each of said hinges being positioned adjacent a respective side edge of said panel;

a stand having a top surface coplanar with said top surface of said platform and said top surface of said panel, said stand being laterally offset from said panel wherein said stand is configured for supporting a person standing on said stand while the person strikes a golf ball sitting upon said panel; and a simulated grass surface being coupled to and covering said top surface of said panel, said simulated grass surface being coupled to and covering said top surface of said platform, said simulated grass surface being coupled to and covering said top surface of said stand.

12. A golf training aid assembly comprising:

a platform having a top surface;

a resiliently flexible member coupled to said platform;

a panel having a first end pivotally coupled to said platform wherein said panel is pivotable relative to said platform, said panel being supported on said resiliently flexible member in spaced relationship to said first end of said panel such that a top surface of said panel is coplanar with said top surface of said platform when said panel rests upon said resiliently flexible member, said panel being downwardly pivotable relative to said top surface of said platform such that said top surface of said panel is configured for being urged downwardly when contacted by a golf club head during a golf swing, said resiliently flexible member being deformable wherein said resiliently flexible member provides resistance to downward pivoting of said panel; and a pair of hinges coupling said first end of said panel to said platform, each of said hinges being positioned adjacent a respective side edge of said panel.

13. The device of claim 12, further comprising a stand having a top surface coplanar with said top surface of said platform and said top surface of said panel, said stand being laterally offset from said panel wherein said stand is configured for supporting a person standing on said stand while the person strikes a golf ball sitting upon said panel.

14. The device of claim 12, further comprising said panel being positioned in a slot extending inwardly into said platform from a forward edge of said platform.

15. The device of claim 14, further comprising a pair of arms coupled to said platform, each said arm extending along a respective side of said slot, said resiliently flexible member being coupled to and extending between said arms.

16. The device of claim 14, further comprising a pair of notches, each notch extending into a top surface of an associated one of said arms, said resiliently flexible member extending through and between said notches.

17. The device of claim 14, further comprising a pair of feet coupled to and extending between said arms, said feet being positioned in spaced parallel relationship relative to each other, said feet abutting a bottom surface of each of said arms.

18. The device of claim 12, further comprising a simulated grass surface being coupled to and covering said top surface of said panel.

19. The device of claim 12, further comprising said resiliently flexible member is a cord having a resiliently stretchable length.

20. The device of claim 12, further comprising said simulated grass surface being coupled to and covering said top surface of said platform.

* * * * *